US006275210B1

(12) United States Patent
Maekawa

(10) Patent No.: US 6,275,210 B1
(45) Date of Patent: Aug. 14, 2001

(54) LIQUID CRYSTAL DISPLAY DEVICE AND DRIVER CIRCUIT THEREOF

(75) Inventor: Toshikazu Maekawa, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/189,790

(22) Filed: Nov. 12, 1998

(30) Foreign Application Priority Data

Dec. 25, 1997 (JP) ..... 9-356577

(51) Int. Cl.[7] ..... G09G 3/36
(52) U.S. Cl. ..... 345/98; 345/100
(58) Field of Search ..... 345/87, 96, 98, 345/204, 213, 100; 327/149, 530, 65

(56) References Cited

U.S. PATENT DOCUMENTS 5,739,805 * 4/1998 Dingwall ..... 345/100
6,067,066 * 5/2000 Kubota et al. ..... 345/98
6,078,318 * 6/2000 Hori et al. ..... 345/204

OTHER PUBLICATIONS

Ghausi, M.S. "Electronic Devices and Circuits" Holt, Rinehart and Winston p. 399, 1985.*

* cited by examiner

*Primary Examiner*—Richard Hjerpe
*Assistant Examiner*—Francis Nguyen
(74) *Attorney, Agent, or Firm*—Ronald P. Kananen; Rader, Fishman & Grauer

(57) ABSTRACT

A data latch circuit of a liquid crystal display device digital input data is converted into data of a power supply voltage level by comparing it with a comparison reference voltage in a comparator section having a PMOS differential amplifier circuit in a sampling period of a sampling pulse signal. The converted data is latched by a first data latch section in a non-sampling period of the sampling pulse signal. The latched data is held for a 1H period by a second data latch section.

9 Claims, 8 Drawing Sheets

LIQUID CRYSTAL DISPLAY DEVICE AND DRIVER CIRCUIT THEREOF

BACKGROUND OF THE INVENTION

The present invention relates to a driver circuit of a liquid crystal display device (hereinafter referred to as an LCD) and, more specifically, to a driver circuit of a matrix type LCD having a data latch circuit for latching digital input data in response to sampling pulses that are generated based on horizontal scanning.

Under the current technologies, in producing what is called a driver circuit integration type LCD in which a driver circuit system is formed by using polysilicon TFTs (thin-film transistors) so as to be integral with a pixel (liquid crystal) system, a high power supply voltage and a high clock pulse voltage are necessarily required because the characteristics of a polysilicon TFT are inferior to those of a single crystal silicon transistor. Typically, a power supply voltage VDD is set higher than 13 V.

At present, low power consumption type mobile computers are being developed and commercialized actively. For an LCD to be used for this purpose, it needs to satisfy a condition of low power consumption. However, as described above, an LCD consumes large power when VDD is set higher than 13 V, for example. Further, since an input timing system needs a high voltage, it is necessary to effect voltage increase from an input voltage of the TTL level or the 2.7-V system to a voltage of the 13-V system inside or outside the LCD panel. Therefore, in the aspect of the system configuration, the use of a booster circuit causes increase in circuit scale and power consumption but also undesired emission.

On the other hand, where the common inversion driving method is used which is a commonly known liquid crystal driving method, a dynamic range of about 5 V is sufficient for a driver circuit system. The common inversion driving method is a driving method which can approximately halve the effective voltage of an external input video signal by varying the opposed electrode voltage with a phase opposite to that of the input signal. Although the common inversion driving method is a promising method for reducing the power consumption of mobile LCDs, the driver circuit system is a major factor of obstructing development of low power consumption LCDs because of insufficient device performance.

SUMMARY OF THE INVENTION

The present invention has been made in view of the above problems in the art, and an object of the invention is to provide a driver circuit which can contribute to reduction in the power consumption of a liquid crystal display device.

The invention provides a liquid crystal display device having a data latch circuit for latching digital input data in response to a sampling pulse signal that is generated based on horizontal scanning, the data latch circuit comprising a comparator section having a PMOS differential circuit that receives the digital input data as an input for comparison and a predetermined comparison reference voltage as an input for reference, for performing a comparison operation in a sampling period of the sampling pulse signal; a first data latch section for latching an output of the comparator section in a non-sampling period of the sampling pulse signal; and a second data latch section for latching output data of the first data latch section in response to an output enable pulse occurring in one horizontal period.

The liquid crystal display device may be of a type further having a shift register and a decoder circuit.

According to another aspect of the invention, there is provided a driver circuit of a liquid crystal display device having a data latch circuit for latching digital input data in response to a sampling pulse signal that is generated based on horizontal scanning, the data latch circuit comprising a comparator section having a PMOS differential circuit that receives the digital input data as an input for comparison and a predetermined comparison reference voltage as an input for reference, for performing a comparison operation in a sampling period of the sampling pulse signal; a first data latch section for latching an output of the comparator section in a non-sampling period of the sampling pulse signal; and a second data latch section for latching output data of the first data latch section in response to an output enable pulse occurring in one horizontal period.

In the above-configured liquid crystal display device or driver circuit, the comparator section converts digital input data of, for example, the 2.7-V system into data of a power supply voltage level by comparing it with a comparison reference voltage by using the PMOS differential circuit. The converted data is latched by the first data latch section in a non-sampling period of a sampling pulse signal. The data latched by the first data latch section is then held for a 1H period (one horizontal period) by the second data latch section.

DETAILED DESCRIPTION OF THE PREFERRED EMBODIMENTS

Figure 1:
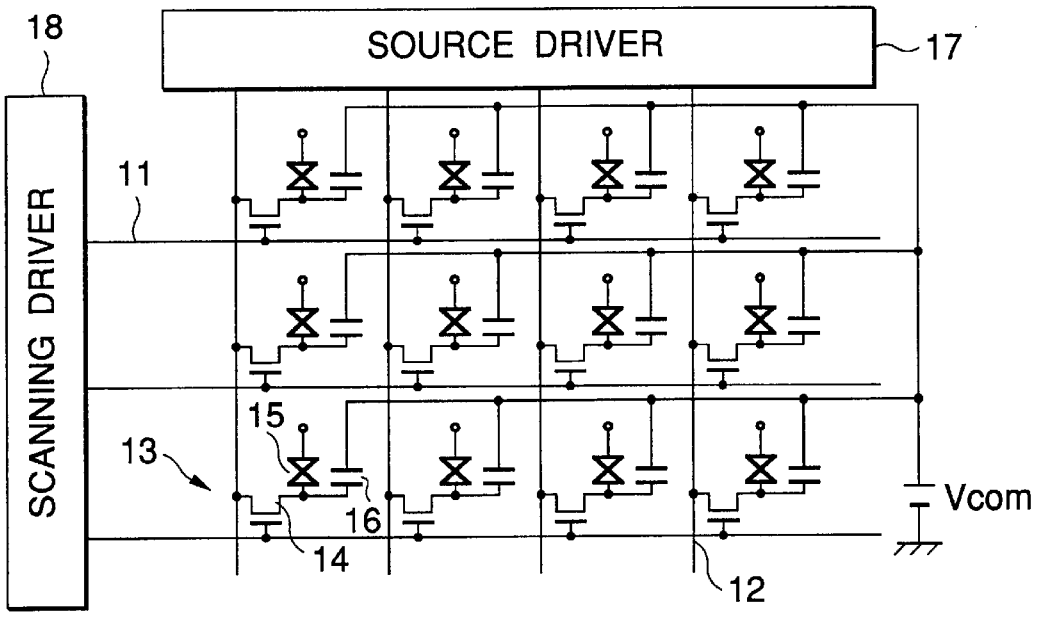
FIG. 1 is a schematic diagram showing a general configuration of an active matrix LCD to which the present invention is applied.

Embodiments of the present invention will be hereinafter described with reference to the accompanying drawings. FIG. 1 is a schematic diagram showing a general configuration of an active matrix LCD to which the invention is applied.

As shown in FIG. 1, a number of pixels 13 are arranged two-dimensionally in matrix form at respective crossing points of gate bus lines 11 (rows) and signal lines (source lines) 12 (columns). Each pixel 13 is composed of a TFT 14 whose gate electrode and source electrode are connected to the associated gate bus line 11 and signal line 12, respectively, a liquid crystal cell whose pixel electrode is connected to a drain electrode of the TFT 14, and an auxiliary capacitor 16 one of whose electrodes is connected to the drain electrode of the TFT 14. A common voltage Vcom is applied to the other electrode of the auxiliary capacitor 16.

The pixels 13 are individually driven by a source driver (horizontal driver circuit) 17 for driving with column-based selection and a scanning driver (vertical driver circuit) 18 for driving with row-based selection. The source driver 17 and the scanning driver 18 incorporate scanning circuits for sequential scanning in the horizontal and vertical directions, respectively. A shift register is used as each scanning circuit.

Figure 2:
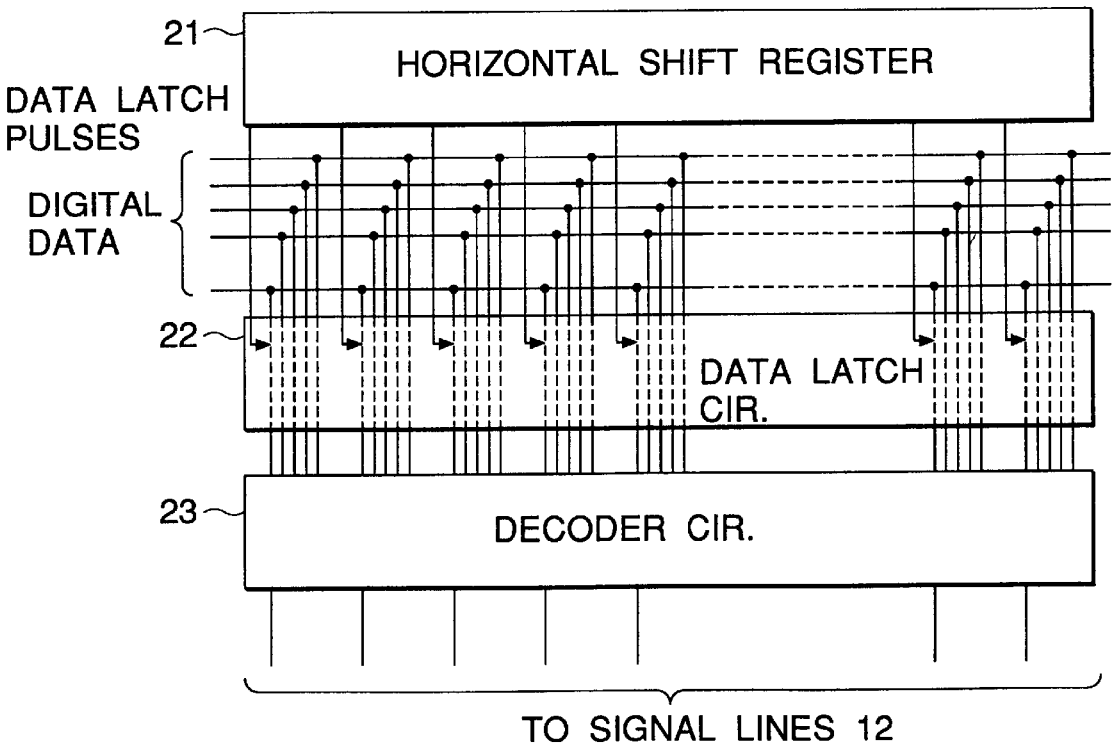
FIG. 2 shows an example configuration of a digital interface source driver.

FIG. 2 shows an example configuration of a digital interface source driver. This digital interface source driver is composed of a horizontal shift register 21 that sequentially outputs data latch pulses as address pulses, a data latch circuit 22 that latches input digital data in synchronism with the data latch pulses that are sequentially output from the horizontal shift register 21, and a decoder circuit 23 that decodes the data that are latched by the data latch circuit 22 and outputs those to the signal lines 12.

As is apparent from the above description, the digital interface source driver needs the data latch circuit 22 that latches input digital data of one line and outputs the 1-line data simultaneously. A data latch circuit according to the invention is one suitably used as such a data latch circuit 22.

Figure 3:
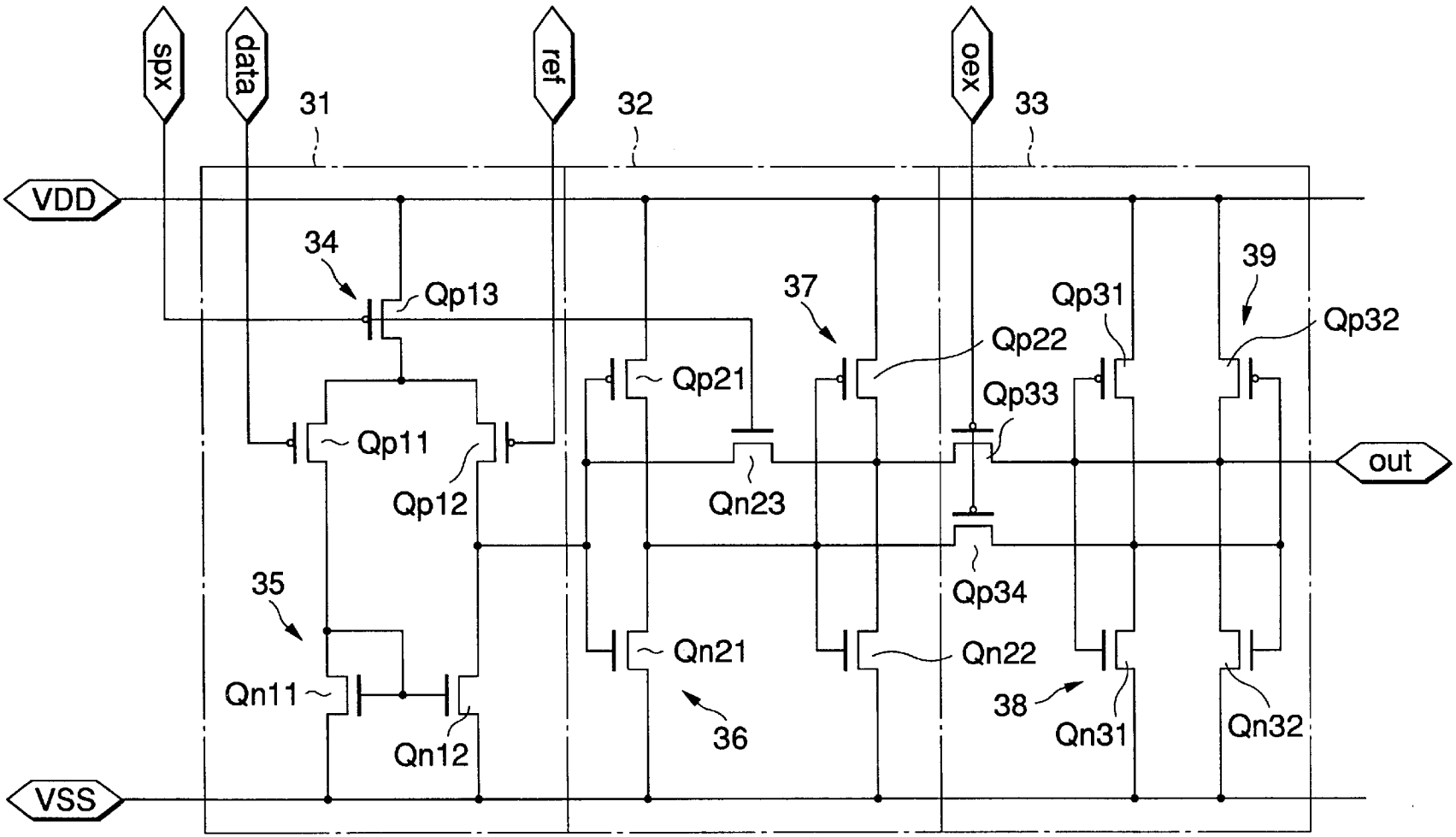
FIG. 3 is a circuit diagram of a data latch circuit according to a first embodiment of the invention.

FIG. 3 is a circuit diagram of a data latch circuit according to a first embodiment of the invention. This embodiment mainly assumes a data latch circuit that is a major component of an LCD that incorporates a digital interface circuit in which a power supply voltage of the 5-V system is used and input data of the 2.7 V system is handled.

The data latch circuit of the first embodiment consists of three blocks, that is, a comparator section 31 for comparing input data "data" with a certain comparison reference voltage "ref," a data latch section-1 32 for latching output data of the comparator section 31, and a data latch section-2 33 for holding output data of the data latch section-1 32 for a 1-line period. An example of a specific circuit configuration of each block will be described below.

First, the comparator section 31 has a PMOS differential amplifier circuit 34 that is composed of differential pair PMOS transistors Qp11 and Qp12 whose sources are in common connection and that operate differentially, and a PMOS transistor Qp13 as a current source connected between a positive voltage source VDD and the source common connection point of the differential pair PMOS transistors Qp11 and Qp12. In the differential amplifier circuit 34, the PMOS transistors Qp11 and Qp12 receive the input data "data" and the comparison reference voltage "ref" as gate inputs, respectively.

For discrimination of the digital input data "data" of the 2.7-V system, the comparison reference voltage "ref" is set at a level between 0 V and 2.7 V, for example, at the center level. The comparison reference voltage "ref" may be either fixed or made externally adjustable in accordance with the level of the digital input data "data." The PMOS transistor Qp13 receives, as a gate input, a data sampling pulse (data latch pulse) "spx" that is supplied from the horizontal shift register 21 shown in FIG. 2.

The differential amplifier circuit 34 has an NMOS current mirror circuit 35 as an active load. Specifically, an NMOS transistor Qn11 having a diode connection in which the gate and the drain are in common connection is connected between the drain of the PMOS transistor Qpll and a negative voltage source VSS. An NMOS transistor Qn12 whose gate is in common connection with the gate of the NMOS transistor Qn11 is connected between the drain of the PMOS transistor Qp12 and the negative voltage source VSS. The NMOS transistors Qn11 and Qn12 constitute the NMOS current mirror circuit 35.

The data latch section-1 32 is composed of a CMOS inverter 36 that consists of a PMOS transistor Qp21 and an NMOS transistor Qn21 that are connected between the positive voltage source VDD and the negative voltage source VSS, a CMOS inverter 37 that consists of a PMOS transistor Qp22 and an NMOS transistor Qn22 that are also connected between the positive voltage source VDD and the negative voltage source VSS, and an NMOS transistor Qn23 as a switching element.

In the data latch section-1 32, the gate common connection point of the PMOS transistor Qp21 and the NMOS transistor Qn21 as the input end of the CMOS inverter 36 is connected to the drain common connection point of the PMOS transistor Qp22 and the NMOS transistor Qn22 as the output end of the CMOS inverter 37 via the NMOS transistor Qn23. A data latch pulse "spx" that is supplied from the horizontal shift register 21 (see FIG. 2) is applied to the gate of the NMOS transistor Qn23.

The gate common connection point of the PMOS transistor Qp22 and the NMOS transistor Qn22 as the input end of the CMOS inverter 37 is connected to the drain common connection point of the PMOS transistor Qp21 and the NMOS transistor Qn21 as the output end of the CMOS inverter 36. That is, the data latch section-1 32 is configured in such a manner that the CMOS inverters 36 and 37 are connected to each other in loop form via the NMOS transistor Qn23.

The data latch section-2 33 is composed of a CMOS inverter 38 that consists of a PMOS transistor Qp31 and an NMOS transistor Qn31 that are connected between the positive voltage source VDD and the negative voltage source VSS, a CMOS inverter 39 that consists of a PMOS transistor Qp32 and an NMOS transistor Qn32 that are also connected between the positive voltage source VDD and the negative voltage source VSS, and PMOS transistors Qp33 and Qp34 for capturing latch data of opposite phases from the data latch section-1 32.

In the data latch section-2 33, the gate common connection point of the PMOS transistor Qp31 and the NMOS transistor Qn31 as the input end of the CMOS inverter 38 is connected to the drain common connection point of the PMOS transistor Qp32 and the NMOS transistor Qn32 as the output end of the CMOS inverter 39. The gate common connection point of the PMOS transistor Qp32 and the NMOS transistor Qn32 as the input end of the CMOS inverter 39 is connected to the drain common connection point of the PMOS transistor Qp31 and the NMOS transistor Qn31 as the output end of the CMOS inverter 38.

That is, the data latch section-2 33 is configured in such a manner that the CMOS inverters 38 and 39 are connected to each other in loop form. The transconductance gmof the CMOS inverters 38 and 39 is set smaller than that of the CMOS inverters 36 and 37 of the data latch section-1 32. This enables data of the data latch section-2 33 to be rewritten reliably by data of the data latch section-1 32.

An output enable pulse (transfer pulse) "oex" is applied to the gates of the PMOS transistors Qp33 and Qp34. Final latch data "out" is output line-by-line from the common connection point of the input end of the CMOS inverter 38 and the output end of the CMOS inverter 39.

Figure 4:
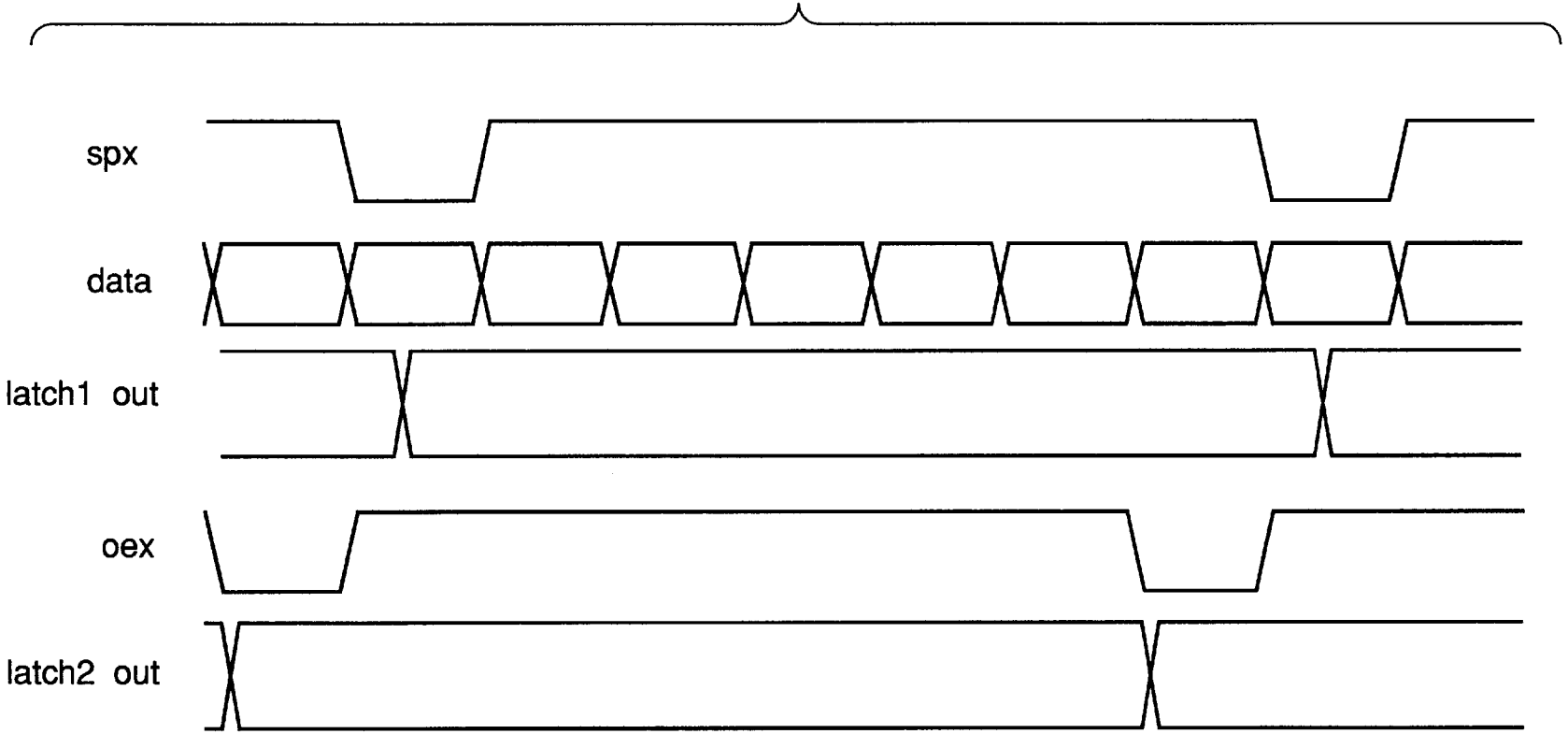
FIG. 4 is a timing chart showing the operation of the data latch circuit of FIG. 3.

Next, the operation of the above-configured data latch circuit according to the first embodiment will be described with reference to a timing chart of FIG. 4. In FIG. 4, the reference symbol "spx" denotes an active-low data sampling pulse signal; "data," digital input data of the 2.7-V system; "ref," a comparison reference voltage for the input data "data"; and "oex," a 1H transfer pulse signal for effecting transfer of data to the data latch section-2 33 in a 1H period (output enable pulse signal); "latch1 out," an output of the data latch section-1; and "latch2 out," an output of the data latch circuit-2 33.

In the comparator section 31, the input data "data" is compared with the comparison reference voltage "ref" to determine whether the former is higher in voltage than the latter in a period when the data sampling pulse signal "spx" is at the low level (hereinafter referred to as the L-level). In the period when the data sampling pulse signal "spx" is at the L-level, in the data latch section-1 32 the NMOS transistor Qn23 is turned off and hence the CMOS inverters 36 and 37 are cascade-connected to have a buffer function of two-stage inverters.

On the other hand, in a period when the data sampling pulse signal "spx" is at the high level (hereinafter referred to as the H-level), in the data latch section-1 32 the NMOS transistor Qn23 is turned on and hence the CMOS inverters 36 and 37 are loop connected to latch the output of the comparator section 31. When the transfer pulse signal "oex" has made a transition from the H-level to the L-level, the PMOS transistors Qp33 and Qp34 of the data latch section-2 33 are turned off and hence the data latch section-2 33 captures the latch output "latch1 out" of the data latch section-1 32 and holds it for a 1H period.

Figure 5:
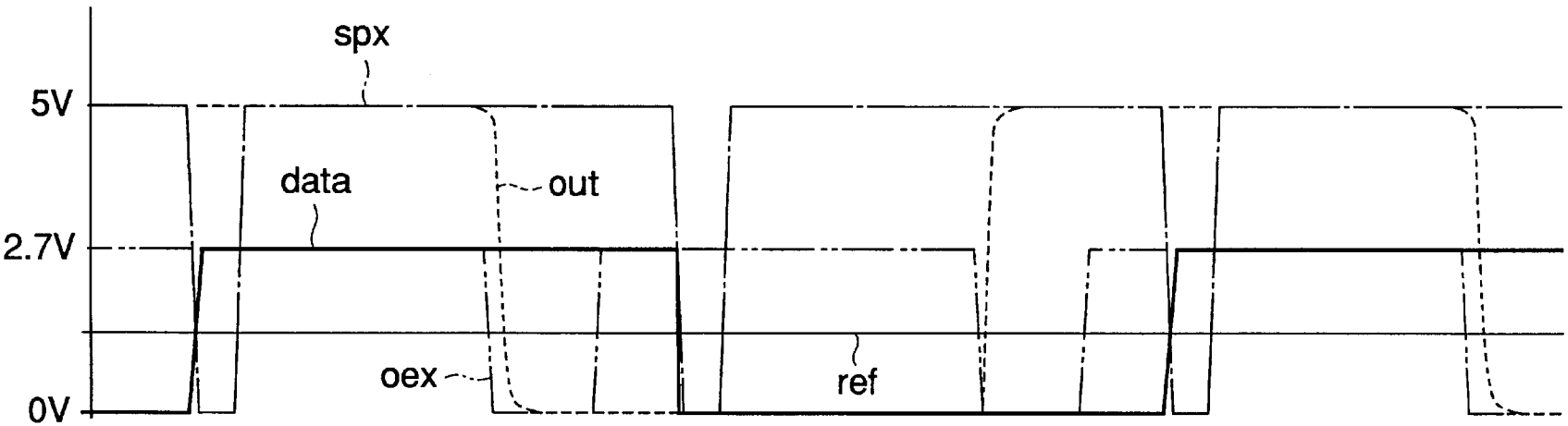
FIG. 5 is a waveform diagram showing a simulation result of the first embodiment.

FIG. 5 shows a simulation result. As is apparent from this simulation result, the digital input data "data" of the 2.7-V system is converted into data of the 5-V system through the comparison with the comparison reference voltage "ref" in the comparator section 31 having the PMOS differential amplifier circuit 34. The data of the 5-V system is latched by the data latch section-1 32 and the data latch section-2 33, and then output as the output "out."

In the above manner, when combined with the common inversion driving method, this embodiment enables construction of a data latch circuit that uses a low power supply voltage (of 5-V system, for example) and handles a low-voltage input signal (of the 2.7-V system, for example). As a result, the embodiment enables reduction in power consumption as well as direct interface with an external timing IC, which simplifies the system. Further, the degree of undesired emission is lowered and hence the set designing is made easier. In particular, because the NMOS transistor Qn23 is used as the switching element of the data latch section-1 32, the embodiment provides an advantage that the data pulse signal "spx" can also be used as the sampling pulse signal.

Where the transfer pulse signal (output enable pulse signal) "oex" is much lower than the power supply voltage (in this embodiment, 5 V) as in a case where the former is of the 2.7-V system, PMOS transistors are used as the two transfer switches at the input stage of the data latch section-2 33 as in the case of the embodiment. On the other hand, in a case where the transfer pulse signal "oex" is close in voltage to the power supply voltage, the two transfer switches may be any of NMOS transistors, PMOS transistors, and CMOS circuits.

Figure 6:
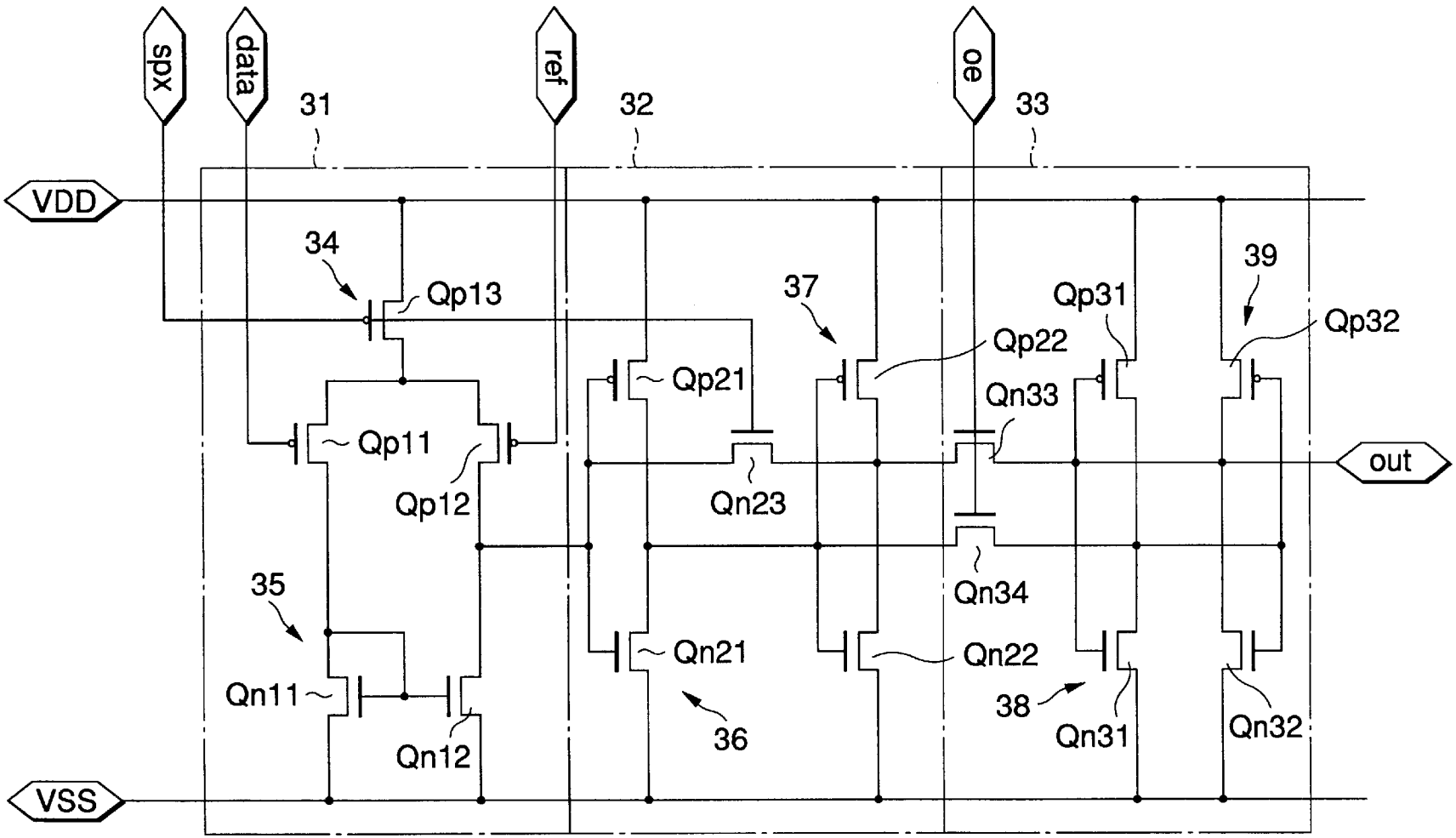
FIG. 6 is a circuit diagram of a data latch circuit according to a modification of the first embodiment.

FIG. 6 shows a modification in which NMOS transistors are used as the two transfer switches at the input stage of the data latch section-2 33. The components in FIG. 6 having the equivalent components in FIG. 3 are given the same reference numerals as the latter. The data latch circuit of this modification is configured in such a manner that NMOS transistors Qn33 and Qn34 are used as the two transfer switches in the data latch section-2 33 and a transfer pulse signal "oe" whose polarity is opposite to that of the transfer pulse signal "oex" is applied to the gates of the NMOS transistors Qn33 and Qn34. That is, the modification uses, as the transfer switches, the MOS transistors whose conductivity type is opposite to that of the MOS transistors used in the first embodiment. In the modification, the circuit operation is basically the same as in the first embodiment.

Figure 7:
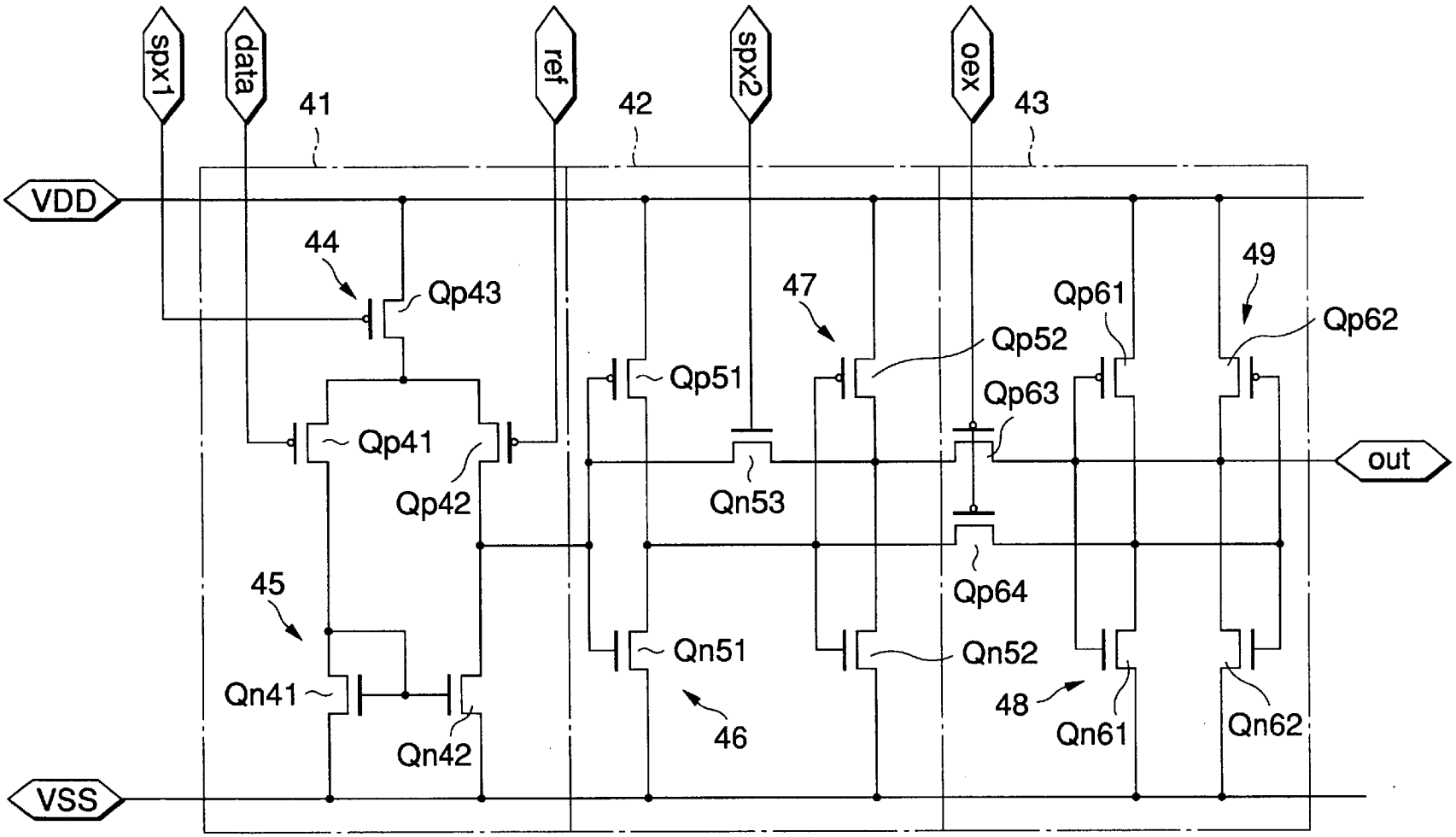
FIG. 7 is a circuit diagram of a data latch circuit according to a second embodiment of the invention.

FIG. 7 is a circuit diagram of a data latch circuit according to a second embodiment of the invention. Like the first embodiment, this embodiment mainly assumes a data latch circuit that is a major component of an LCD that incorporates a digital interface circuit in which a power supply voltage of the 5-V system is used and input data of the 2.7 V system is handled.

Like the data latch circuit of the first embodiment, the data latch circuit of the second embodiment consists of three blocks, that is, a comparator section 41 for comparing input data "data" with a certain comparison reference voltage "ref," a data latch section-1 42 for latching output data of the comparator section 41, and a data latch section-2 43 for holding output data of the data latch section-1 42 for a 1-line period. An example of a specific circuit configuration of each block will be described below.

First, the comparator section 41 has a PMOS differential amplifier circuit 44 that is composed of differential pair PMOS transistors Qp41 and Qp42 whose sources are in common connection and that operate differentially, and a PMOS transistor Qp43 as a current source connected between a positive voltage source VDD and the source common connection point of the differential pair PMOS transistors Qp41 and Qp42. In the differential amplifier circuit 44, the PMOS transistors Qp41 and Qp42 receive the input data "data" and the comparison reference voltage "ref" as gate inputs, respectively.

For discrimination of the digital input data "data" of the 2.7-V system, the comparison reference voltage "ref" is set at a level between 0 V and 2.7 V, for example, at the center level. The comparison reference voltage "ref" may be either fixed or made externally adjustable in accordance with the level of the digital input data "data." The PMOS transistor Qp43 receives, as a gate input, a data sampling pulse (data latch pulse) "spx1" that is supplied from the horizontal shift register 21 shown in FIG. 2.

The differential amplifier circuit 44 has an NMOS current mirror circuit 45 as an active load. Specifically, an NMOS transistor Qn41 having a diode connection in which the gate and the drain are in common connection is connected between the drain of the PMOS transistor Qp41 and a negative voltage source VSS. An NMOS transistor Qn42 whose gate is in common connection with the gate of the NMOS transistor Qn41 is connected between the drain of the PMOS transistor Qp42 and the negative voltage source VSS. The NMOS transistors Qn41 and Qn42 constitute the NMOS current mirror circuit 45.

The data latch section-1 42 is composed of a CMOS inverter 46 that consists of a PMOS transistor Qp51 and an NMOS transistor Qn51 that are connected between the positive voltage source VDD and the negative voltage source VSS, a CMOS inverter 47 that consists of a PMOS transistor Qp52 and an NMOS transistor Qn52 that are also connected between the positive voltage source VDD and the negative voltage source VSS, and an NMOS transistor Qn53 as a switching element.

In the data latch section-1 42, the gate common connection point of the PMOS transistor Qp51 and the NMOS transistor Qn51 as the input end of the CMOS inverter 46 is connected to the drain common connection point of the PMOS transistor Qp52 and the NMOS transistor Qn52 as the output end of the CMOS inverter 47 via the NMOS transistor Qn53.

Figure 8:
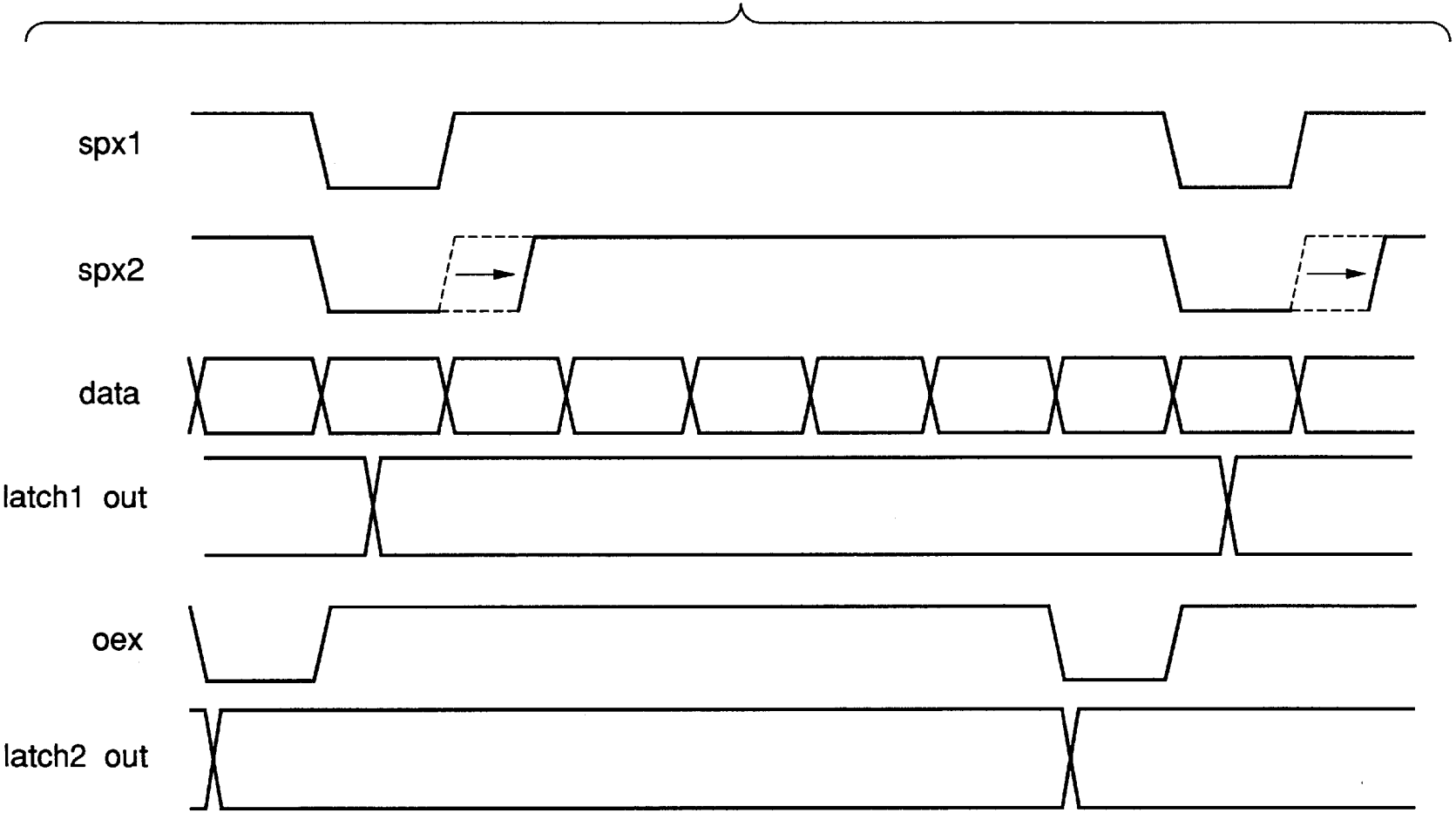
FIG. 8 is a timing chart showing the operation of the data latch circuit of FIG. 7.

A data latch pulse "spx2" that is generated based on the data latch pulse "spx1" is applied to the gate of the NMOS transistor Qn53. As shown in a timing chart of FIG. 8, the data latch pulse "spx2" is generated based on the data latch pulse "spx1" so as to have a waveform in which the L-level pulse width is greater than that of the data latch pulse "spx1," that is, a transition from the L-level to the H-level occurs later than that of the data latch pulse "spx1."

The gate common connection point of the PMOS transistor Qp52 and the NMOS transistor Qn52 as the input end of the CMOS inverter 47 is connected to the drain common connection point of the PMOS transistor Qp51 and the NMOS transistor Qn51 as the output end of the CMOS inverter 46. That is, the data latch section-1 42 is configured in such a manner that the CMOS inverters 46 and 47 are connected to each other in loop form via the NMOS transistor Qn53.

The data latch section-2 43 is composed of a CMOS inverter 48 that consists of a PMOS transistor Qp61 and an NMOS transistor Qn61 that are connected between the positive voltage source VDD and the negative voltage source VSS, a CMOS inverter 49 that consists of a PMOS transistor Qp62 and an NMOS transistor Qn62 that are also connected between the positive voltage source VDD and the negative voltage source VSS, and PMOS transistors Qp63 and Qp64 for capturing latch data of opposite phases from the data latch section-1 42.

In the data latch section-2 43, the gate common connection point of the PMOS transistor Qp61 and the NMOS transistor Qn61 as the input end of the CMOS inverter 48 is connected to the drain common connection point of the PMOS transistor Qp62 and the NMOS transistor Qn62 as the output end of the CMOS inverter 49. The gate common connection point of the PMOS transistor Qp62 and the NMOS transistor Qn62 as the input end of the CMOS inverter 49 is connected to the drain common connection point of the PMOS transistor Qp61 and the NMOS transistor Qn61 as the output end of the CMOS inverter 48.

That is, the data latch section-2 43 is configured in such a manner that the CMOS inverters 48 and 49 are connected to each other in loop form. The transconductance gm of the CMOS inverters 48 and 49 is set smaller than that of the CMOS inverters 46 and 47 of the data latch section-1 42. This enables data of the data latch section-2 43 to be rewritten reliably by data of the data latch section-1 42.

An output enable pulse (transfer pulse) "oex" is applied to the gates of the PMOS transistors Qp63 and Qp64. Final latch data "out" is output line-by-line from the common connection point of the input end of the CMOS inverter 48 and the output end of the CMOS inverter 49.

The above-configured data latch circuit of the second embodiment is the same as the data latch circuit of the first embodiment with a single exception that the data latch pulse "spx2" that is different from the data latch pulse "spx1" is applied to the NMOS transistor Qn53 of the data latch section-1 42, and hence the circuit operation of the data latch circuit of the second embodiment is basically the same as that of the first embodiment.

The second embodiment can delay the latching because the sampling pulse data (latch pulse signal "spx1") and the latch pulse signal (latch pulse signal "spx2") are separated from each other and the L-level to H-level transition point of the latch pulse signal "spx2" is set later than that of the data latch pulse signal "spx1." Therefore, the second embodiment provides, in addition to the advantages of the first embodiment, an advantage that the margin of the data latching can be increased.

Figure 9:
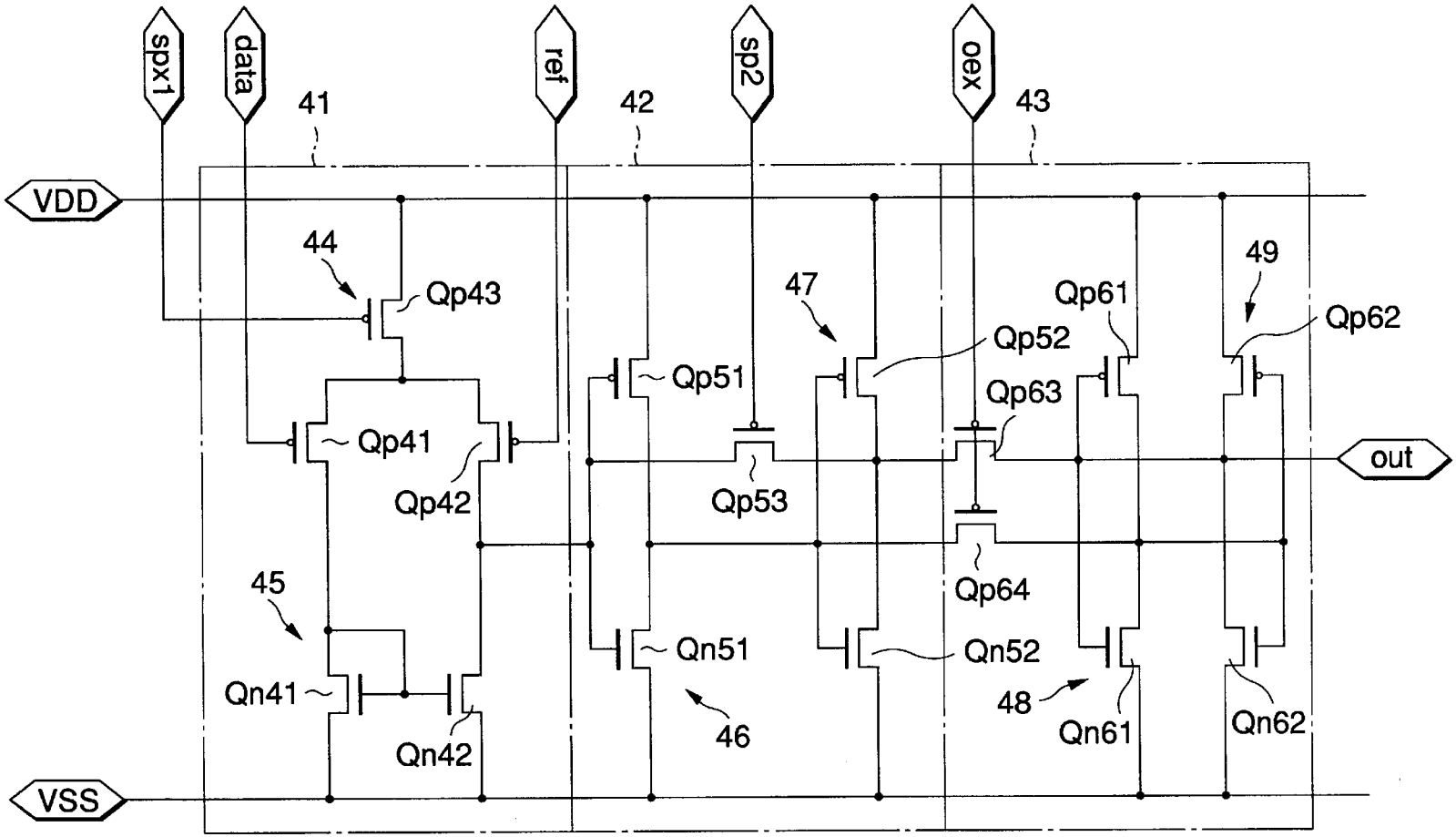
FIG. 9 is a circuit diagram of a data latch circuit according to a modification of the second embodiment.

FIG. 9 is a circuit diagram of a data latch circuit according to a modification of the second embodiment. The components in FIG. 9 having the equivalent components in FIG. 7 are given the same reference numerals as the latter. The data latch circuit of this modification is configured in such a manner that a PMOS transistor Qp53 is used as the switching element connected between the input end of the CMOS inverter 46 and the output end of the CMOS inverter 47 in the data latch section-1 42 and a data latch pulse signal "sp2" whose polarity is opposite to that of the data latch pulse signal "spx2" is applied to the gate of the PMOS transistor Qp53. A CMOS circuit may be used instead of the PMOS transistor Qp53.

Although illustration is omitted, a modification is possible in which, as in the case of the modification of the first embodiment, NMOS transistors are used in place of the two PMOS transistors Qp63 and Qp64 at the input stage of the data latch section-2 43 and a transfer pulse signal "oe" whose polarity is opposite to that of the transfer pulse signal "oex" is applied to the gates of the NMOS transistors. In each of the above modifications, the circuit operation is basically the same as in the second embodiment.

Although the above embodiments are assumed to be applied to a driver circuit integration type LCD in which a driver circuit system is formed by using polysilicon TFTs so as to be integral with a pixel system, the invention can similarly be applied to a driver circuit separation type LCD. Transistors used in the invention may be formed by using either polysilicon or single crystal silicon. Further, transistors maybe either bulk silicon transistors or TFTs formed on an insulating layer. TFTs are suitable for low-voltage driving because increase in |Vth| due to the substrate bias effect does not occur.

As described above, in the invention, digital input data is converted into data of a power supply voltage level by comparing it with a comparison reference voltage by using a PMOS differential circuit, the converted data is latched in a non-sampling period of a sampling pulse signal, and the latched data is held for a 1H period. Therefore, a data latch circuit can be constructed which uses a low power supply voltage (of the 5-V system, for example) and handles a low-voltage data signal (of the 2.7-V system, for example). Such a data latch circuit makes it possible to reduce the power consumption of a liquid crystal display device.

What is claimed is:

1. A liquid crystal display device having a data latch circuit for latching digital input data in response to a sampling pulse signal that is generated based on horizontal scanning, the latch circuit comprising:

a comparator section having a PMOS differential circuit that receives the digital input data as an input for comparison and a predetermined comparison reference voltage as an input for reference, for performing a comparison operation in a sampling period of the sampling pulse signal;

a first data latch section for latching an output of the comparator section in a non-sampling period of the sampling pulse signal; and a second data latch section for latching output data of the first data latch section in response to an output enable pulse occurring in one horizontal period;

wherein the first data latch section comprises a first inverter having an input end that is connected to an output end of the comparator section, a second inverter having an input end that is connected to an output end of the first inverter, and a switching element that is connected between the input end of the first inverter and the output end of the second inverter and turned on in the non-sampling period of the sampling pulse signal.

2. A liquid crystal display device having a data latch circuit for latching digital input data in response to a sampling pulse signal that is generated based on horizontal scanning, the latch circuit comprising:

a comparator section having a PMOS differential circuit that receives the digital input data as an input for comparison and a predetermined comparison reference voltage as an input for reference, for performing a comparison operation in a sampling period of the sampling pulse signal;

a first data latch section for latching an output of the comparator section in a non-sampling period of the sampling pulse signal; and a second data latch section for latching output data of the first data latch section in response to an output enable pulse occurring in one horizontal period;

wherein the second data latch section comprises a transfer switch for transferring the output data of the first data latch section in response to the output enable pulse, a first inverter having an input end that is connected to an output end of the transfer switch, and a second inverter having an input end and an output end that are connected to an output end and the input end of the first inverter, respectively.

3. The liquid crystal display device according to claim 2, wherein the first and second inverters of the second data latch section have a smaller transconductance than those of the first data latch section.

4. A liquid crystal display device having a shift register, a decoder circuit, and a data latch circuit for latching digital input data in response to a pulse of a sampling pulse signal that is generated based on horizontal scanning, the data latch circuit comprising:

a comparator section having a PMOS differential circuit that receives the digital input data as an input for comparison and a predetermined comparison reference voltage as an input for reference, for performing a comparison operation in a sampling period of the sampling pulse signal;

a first data latch section for latching an output of the comparator section in a non-sampling period of the sampling pulse signal; and a second data latch section for latching output data of the first data latch section in response to an output enable pulse occurring in one horizontal period;

wherein the first data latch section comprises a first inverter having an input end that is connected to an output end of the comparator section, a second inverter having an input end that is connected to an output end of the first inverter, and a switching element that is connected between the input end of the first inverter and the output end of the, second inverter and turned on in the non-sampling period of the sampling pulse signal.

5. A liquid crystal display device having a shift register, a decoder circuit, and a data latch circuit for latching digital input data in response to a pulse of a sampling pulse signal that is generated based on horizontal scanning, the data latch circuit comprising:

a comparator section having a PMOS differential circuit that receives the digital input data as an input for comparison and a predetermined comparison reference voltage as an input for reference, for performing a comparison operation in a sampling period of the sampling pulse signal;

a first data latch section for latching an output of the comparator section in a non-sampling period of the sampling pulse signal; and a second data latch section for latching output data of the first data latch section in response to an output enable pulse occurring in one horizontal period;

wherein the second data latch section comprises a transfer switch for transferring the output data of the first data latch section in response to the output enable pulse, a first inverter having an input end that is connected to an output end of the transfer switch, and a second inverter having an input end and an output end that are connected to an output end and the input end of the first inverter, respectively.

6. The liquid crystal display device according to claim 5, wherein the first and second inverters of the second data latch section have a smaller transconductance than those of the first data latch section.

7. A driver circuit of a liquid crystal display device having a data latch circuit for latching digital input data in response to a sampling pulse signal that is generated based on horizontal scanning, the data latch circuit comprising:

a comparator section having a PMOS differential circuit that receives the digital input data as an input for comparison and a predetermined comparison reference voltage as an input for reference, for performing a comparison operation in a sampling period of the sampling pulse signal;

a first data latch section for latching an output of the comparator section in a non-sampling period of the sampling pulse signal; and a second data latch section for latching output data of the first data latch section in response to an output enable pulse occurring in one horizontal period;

wherein the first data latch section comprises a first inverter having an input end that is connected to an output end of the comparator section, a second inverter having an input end that is connected to an output end of the first inverter, and a switching element that is connected between the input end of the first inverter and the output end of the second inverter and turned on in the non-sampling period of the sampling pulse signal.

8. A driver circuit of a liquid crystal display device having a data latch circuit for latching digital input data in response to a sampling pulse signal that is generated based on horizontal scanning, the data latch circuit comprising:

a comparator section having a PMOS differential circuit that receives the digital input data as an input for comparison and a predetermined comparison reference voltage as an input for reference, for performing a comparison operation in a sampling period of the sampling pulse signal;

a first data latch section for latching an output of the comparator section in a non-sampling period of the sampling pulse signal; and a second data latch section for latching output data of the first data latch section in response to an output enable pulse occurring in one horizontal period;

wherein the second data latch section comprises a transfer switch for transferring the output data of the first data latch section in response to the output enable pulse, a first inverter having an input end that is connected to an output end of the transfer switch, and a second inverter having an input end and an output end that are connected to an output end and the input end of the first inverter, respectively.

9. The driver circuit according to claim 8, wherein the first and second inverters of the second data latch section have a smaller transconductance than those of the first data latch section.

* * * * *